US007690854B2

(12) United States Patent
Delage

(10) Patent No.: US 7,690,854 B2
(45) Date of Patent: Apr. 6, 2010

(54) DEVICE FOR PACKAGING AND APPLYING A PRODUCT, IN PARTICULAR A COSMETIC PRODUCT

(75) Inventor: Jean-Francois Delage, Clamart (FR)

(73) Assignee: L'Oreal, Paris (FR)

( * ) Notice: Subject to any disclaimer, the term of this patent is extended or adjusted under 35 U.S.C. 154(b) by 1006 days.

(21) Appl. No.: 11/418,369

(22) Filed: May 5, 2006

(65) Prior Publication Data

US 2006/0257201 A1 Nov. 16, 2006

Related U.S. Application Data

(60) Provisional application No. 60/682,840, filed on May 20, 2005.

(30) Foreign Application Priority Data

May 12, 2005 (FR) ..... 05 51242

(51) Int. Cl.
*B43K 5/00* (2006.01)

(52) U.S. Cl. ..... 401/205; 401/108; 401/281

(58) Field of Classification Search ..... 401/107, 401/108, 116, 117, 183–186, 204, 205, 270, 401/280, 281
See application file for complete search history.

(56) References Cited

U.S. PATENT DOCUMENTS 2,827,650 A * 3/1958 Morrill et al. ..... 401/186
5,085,347 A 2/1992 Hayes et al.
5,397,195 A * 3/1995 Goncalves ..... 401/277
6,000,633 A 12/1999 Lund et al.
6,158,913 A * 12/2000 Dumler et al. ..... 401/191
7,329,062 B2 * 2/2008 Brand et al. ..... 401/108
2003/0075200 A1 4/2003 Gueret

FOREIGN PATENT DOCUMENTS

EP 1 020 135 7/2000
EP 1 193 188 4/2002

* cited by examiner

*Primary Examiner*—David J Walczak
(74) *Attorney, Agent, or Firm*—Oblon, Spivak, McClelland, Maier & Neustadt, L.L.P.

(57) ABSTRACT

A packaging and applying device. The device is particularly advantageous for packaging and applying a cosmetic product, and includes a container holding the product; and an applicator element designed to be supplied with product via a passage in permanent or selective communication with the inside of the container. The applicator element includes an application surface intended to be placed in contact with a surface to be treated. The applicator element is carried by a mobile or movable member designed to move from a first position in which the applicator element is outside or faces outwardly from a recess, to a second position in which the applicator element is contained within the recess. The movable member additionally can perform the following functions when it is in the second position: prevent the actuation of a dispensing element fitted on the container, and/or close off the product delivery passage to the applicator element.

35 Claims, 6 Drawing Sheets

DEVICE FOR PACKAGING AND APPLYING A PRODUCT, IN PARTICULAR A COSMETIC PRODUCT

CROSS-REFERENCE TO RELATED APPLICATIONS

This document claims priority to French Application Number 05 51242, filed May 12, 2005 and U.S. Provisional Application No. 60/682,840, filed May 20, 2005, the entire contents of which are hereby incorporated by reference.

BACKGROUND OF THE INVENTION

1. Field of the Invention

The present invention relates to devices for packaging and applying a product. This invention is particularly advantageous for packaging and applying a cosmetic product, and especially a skin care product. The invention relates more particularly to a novel packaging and applicator device of the type including an applicator element to apply the product and a container to hold the product. Such devices generally include a recess for the applicator element which communicates with the inside of the container in the storage position.

2. Discussion of Background

European patent application EP 1 020 135 describes for example a device in which the applicator element is carried by a closure element of the container. The closure element includes a recess capable of accommodating the applicator element when the container is closed by the closure element which screws onto the container. The recess is in permanent communication with the inside of the container.

European patent application EP 1 193 188 also describes a device of this type in which the applicator element is in this case integral with a support element pivoting relative to the container between a closed position in which the applicator element is accommodated in a recess and a use position. Here again, in the closed position, the recess housing the applicator element is in permanent communication with the inside of the container.

U.S. Pat. Nos. 5,085,347 and 6,000,633 describe product spray devices which can assume a use position and a storage position in which the product cannot be sprayed. In the use position, these devices enable the product to be sprayed by means of a nozzle which is not configured to be placed in contact with the surface onto which the product is sprayed, with the device remaining at a distance from the surface to be treated.

SUMMARY OF THE INVENTION

There is a need to provide a packaging and applicator device which readily allows the applicator element to be stowed in an environment isolated from the inside of the container.

The invention meets this need by providing a device for packaging and applying a product which includes a container holding the product, and an applicator element designed to be supplied with product via a passage in permanent or selective communication with the inside of the container. The applicator element includes an application surface intended to be placed in contact with a surface to be treated. In addition, the applicator element is carried by a movable member designed to pass from a first position in which the applicator element is outside a recess surmounting the container, to a second position in which the applicator element is contained within the recess. The movable member includes a portion closing off the recess in this second position. Further, according to a preferred example, the movable member additionally performs the following functions when it is in the second position: (1) prevent the actuation of a dispensing element fitted on the container, and/or (2) close off the product delivery passage to the applicator element.

According to a preferred example, the applicator element can be readily stowed so as to protect it from the outside, in an environment isolated from the inside of the container.

By way of example, the movable member can be rotatably movable between the first and the second position and can be displaced through approximately 180° between the first and the second position.

In a first embodiment, by way of example, the movable member can be rotatably movable about a tubular wall partly delineating the product delivery passage. The movable member can include a conduit portion mounted on the tubular wall. The conduit portion is capable of closing off a hole provided in the tubular wall thereby closing off the passage when the movable member is in the second position. The conduit portion can be extended by a conduit which emerges via a dispensing aperture. The conduit is capable of being placed against the hole in the tubular wall when the movable member is in the first position.

In a second embodiment, by way of example, the movable member can be rotatably movable about an actuating element of the dispensing element. In addition, the movable member is additionally designed to move downward along the axis of the actuating element to actuate the dispensing element when the movable member is in the first position. In this embodiment, the movable member can include a wall designed to abut against a support of the dispensing element when the movable member is in the second position.

The movable member can include a handle enabling the movable member to be grasped so that it can be turned, with the handle also being capable of abutting against a stop in the first and the second position.

By way of example, the applicator element can communicate with the ambient air when it is contained within the recess. The recess can include at least one passage enabling the applicator element to communicate with the ambient air when the recess is closed. Thus, the applicator element is able to dry out between uses, which limits the risk of microbiological growth and can make it possible, for example, to reduce the quantity of preservatives in the product or biocidal agents incorporated into the applicator element, for example when the applicator element includes a porous material.

Also by way of example, the applicator element can be compressible. It can include a foam or an elastomer.

By way of example, the applicator element can include a domed application surface.

The passage for the product can emerge via a dispensing aperture to the outside of the application surface or inside the applicator element so as to impregnate the applicator element when it is porous.

Also by way of example, the applicator element can be made of a porous material.

The applicator element can be bonded to the movable member by a face opposite its application surface. Alternatively, the applicator element can be detachably mounted on the movable member so that it can be picked up before being applied on the surface to be treated. The applicator element can, for example, be attached to the movable member by friction fit around a conduit emerging via the dispensing aperture.

The container can be delineated by a flexible wall whereon the user can press to dispense the product. As a variant, a dispensing element in the form of a pump incorporating an actuating element can dispense a quantity of product in response to an actuation command, when the movable member is in the first position.

The product can be a cosmetic product, for example a foundation or a moisturizing product. The product can be fluid, such as a liquid or a powder.

As should be apparent, the invention can provide a number of advantageous features and benefits. It is to be understood that, in practicing the invention, an embodiment can be constructed to include one or more features or benefits of embodiments disclosed herein but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood from the following detailed description of non-limitative embodiments, and by reference to the attached drawing in which.

DETAILED DESCRIPTION OF THE DRAWINGS

The packaging and applicator device 1 depicted in the example of FIGS. 1 to 6 includes a container 10 and an applicator element 20 carried by a movable member 30.

Figure 4:
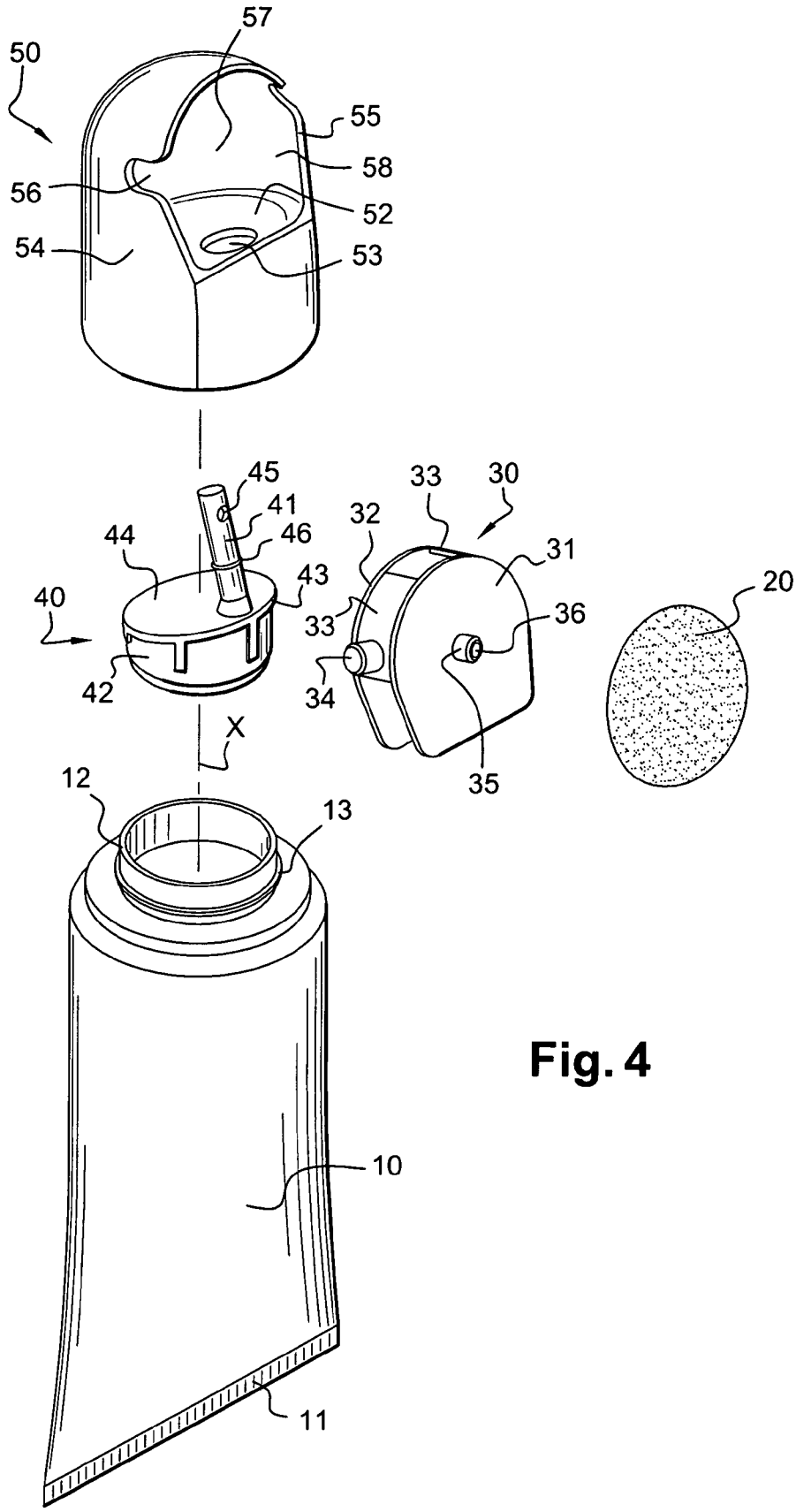
FIG. 4 illustrates an exploded view of the device in FIG. 1.

As can be seen in greater detail in FIG. 4, the container 10 in this example is in the form of a tube elongated on an axis X. A first end 11 is crimped and the opposite end terminates at a neck 12 along axis X. The container preferably has deformable walls.

The container 10 preferably holds a cosmetic product, for example, a foundation or a moisturising product. The product is fluid, for example liquid.

A support 40 carries a tubular wall 41, and is mounted in the opening of the neck 12, by a mounting skirt 42 which bears in a leaktight manner inside the neck 12. The upper edge 43 of the mounting skirt 42 is bevelled and is closed by a transverse wall 44 oblique relative to the axis X. The tubular wall 41 extends from the wall 44, perpendicular to the latter, so that it extends obliquely relative to the axis X. The tubular wall 41 is located at the highest part of the wall 44, close to its periphery. The tubular wall 41 is closed at its upper end and opens laterally via a hole 45 placed in proximity to its upper end and turned outward from the wall 44.

The movable member 30 includes two mutually parallel walls 31 and 32 spaced apart from one another. The two walls 31 and 32 are connected to one another by side walls 33 on only a part of their periphery. A handle 34 is provided between the two walls to manipulate the movable member. In this example, one of the two walls 31 additionally includes a conduit 35 which passes through its central part and which extends perpendicular to the wall 31, on either side of the latter. The conduit 35 emerges, at the outside of the wall 31, via a dispensing aperture 36 and extends between the two walls 31 and 32 by a conduit portion 37 parallel to the walls 31 and 32, which is configured to fit over the tubular wall 41 in a leaktight manner relative to the product. The tubular wall 41 thus serves as an axis of rotation for the movable member about which it can turn. A ring 46 provided on the outer surface of the tubular wall 41 engages with a counterpart groove 38 provided on the inner surface of the conduit 37 thereby ensuring attachment of the movable member 30 on the tubular wall 41.

The movable member 30 carries the applicator element 20 which is, for example, bonded to the wall 31 by a flat face 21. The applicator element 20 is porous in this example. The element 20 can be made of open cell polyurethane foam, for example. The applicator element 20 is hemispherical in shape, with its domed face constituting the application surface 22. The foam is hollowed out at its central part on its face 21 so as to fit over the conduit 35 which projects beyond the wall 31. Preferably, the hollow 23 formed in the foam is shaped such that the foam fits tightly around the conduit 35 but is some distance from the end of the conduit, i.e. from the dispensing aperture 36, to enable the product to emerge. In addition, the application surface 22 is located at a distance from the conduit 35 to prevent the conduit 35 from making contact with the surface to be treated and thus avoid any injury during application.

In the illustrated example, a cap 50 is mounted on the container via a fixing skirt 51, parallel to the axis X, which snaps onto a bead 13 provided on the neck 12 of the container. The fixing skirt 51 includes a bevelled upper edge which is closed by a transverse wall 52, oblique relative to the axis X. The transverse wall 52 includes a passage 53 for the tubular wall 41.

Further, by way of example, an outer wall forming a shell 54 surrounds the fixing skirt 51 around its entire periphery and over its full height. The shell 54 is connected to the upper edge of the fixing skirt 51 on the forward part of its periphery. The shell 54 extends above the transverse wall 52 by a portion open at the front so as to receive the movable member 30 fitted with the applicator element 20. The edge 55 of the shell which delineates its opening 58 has a shape counterpart to that of the movable member so that the movable member is able to close off this opening. Two notches 56 are also provided on the edge 55, on either side of the opening 58, to receive the handle 34.

A recess 57 is thus delineated by the upper part of the shell 54, the transverse wall 52 and the movable member 30, with the recess being capable of accommodating the applicator element 20 in the storage position.

Figure 1:
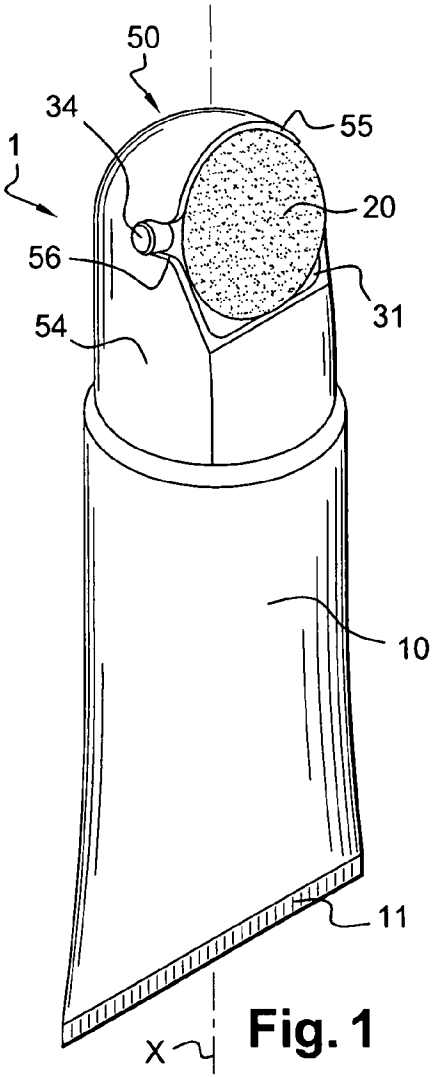
FIGS. 1 to 3 illustrate perspective views of a first example of a packaging and applicator device according to the invention, in different positions.
Figure 5:
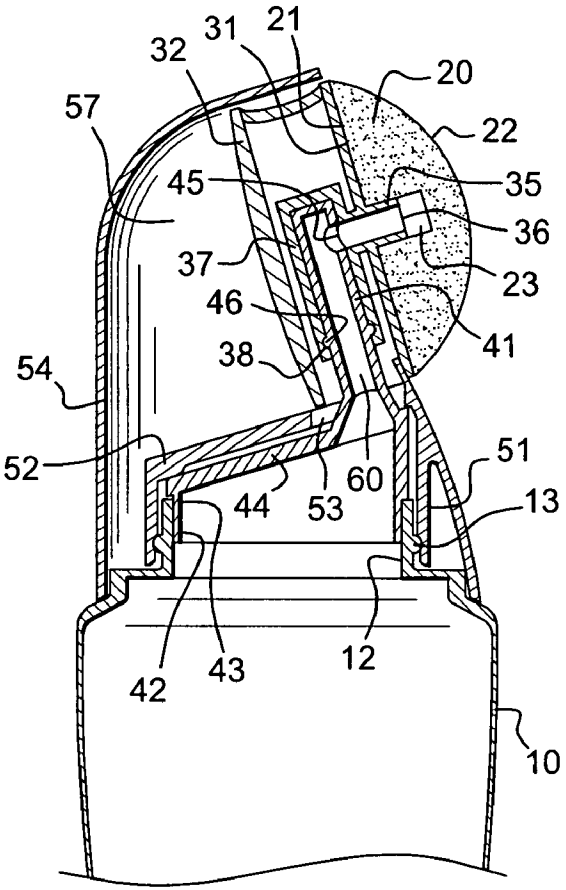
FIG. 5 illustrates, in axial cross section, the device in FIG. 1 in the use position.

In a use or application position depicted in FIGS. 1 and 5, the movable member 30 is in a first position, that is to say the wall 31 carrying the applicator element 20 extends into the opening 58 in the shell. The applicator element 20 is then situated outside the shell and can be applied on the surface to be treated.

In this use or application position, the conduit 35 passing through the wall 31 is against the lateral hole 45 in the tubular wall 41 thereby forming a product delivery passage 60 between the inside of the container 10 and the dispensing aperture 36, with the passage 60 being delineated by the tubular wall 41 and the conduit 35.

In the illustrated example, to ensure that the conduit 35 is effectively positioned against the hole 45, the handle 34 advantageously abuts against the edge 55 of the shell in this position, with the handle being located in the notch 56. The user is thus assured that the passage 60 is properly formed.

By pressing on the walls of the tube 10, the product is expelled from the tube to the dispensing aperture 36 via the passage 60. The product arrives at the applicator element 20 which is impregnated until the product arrives at the application surface 22. The application surface need only then be placed in contact with the surface to be treated in order to apply the product.

When the application is complete, the user can stow the applicator element 20 to prevent it from being soiled between uses.

Figure 2:
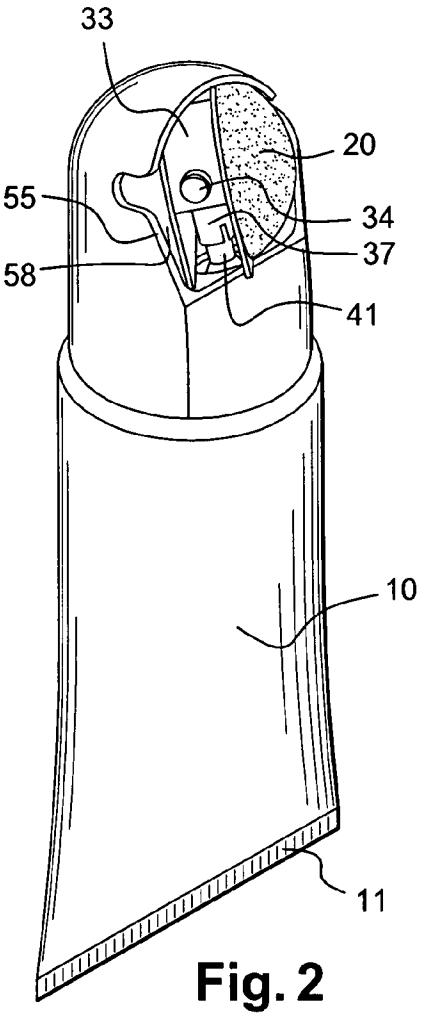
Figure 3:
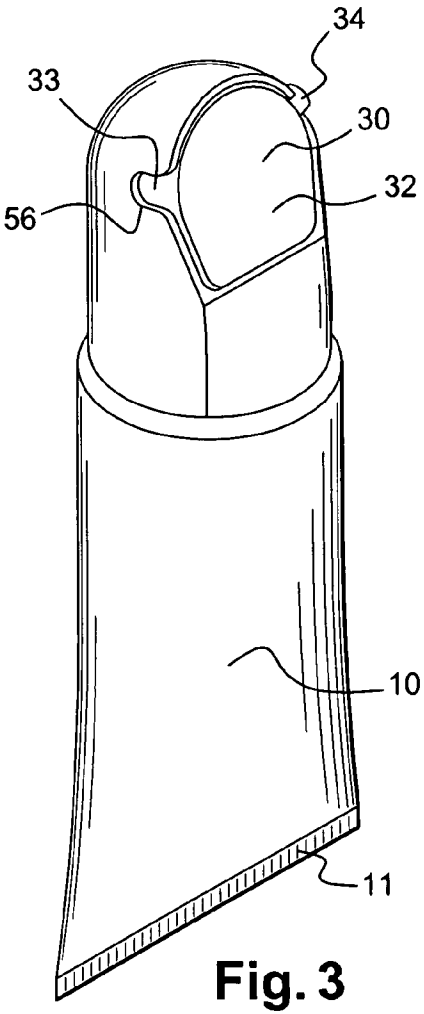
Figure 6:
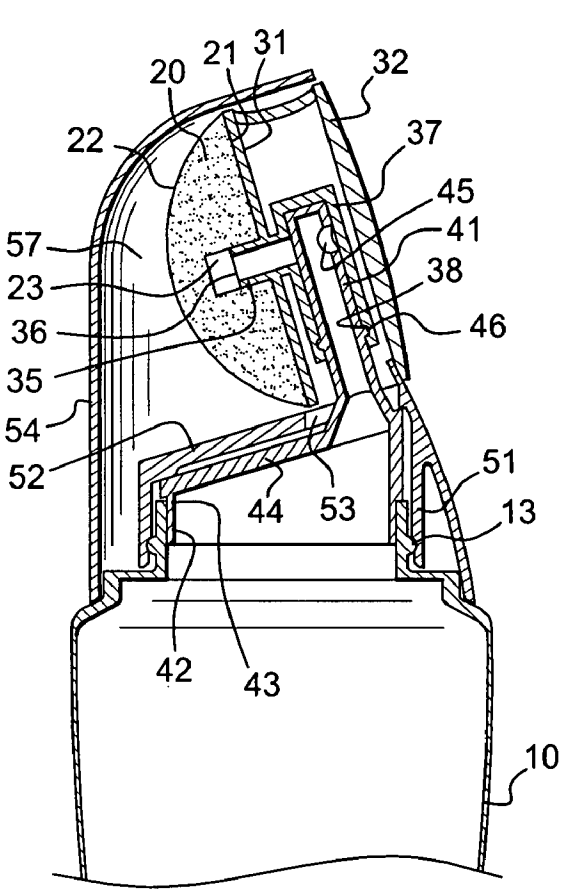
FIG. 6 illustrates, in axial cross section, the device in FIG. 1 in the closed position.

To do this, the user turns the movable member 30 by grasping the handle 34, as can be seen in FIG. 2, until it has rotated through 180°. The device is thus in its storage position, as depicted in FIGS. 3 and 6, a position in which the applicator element 20 is wholly enclosed within the recess 57. The recess 57 is closed by the wall 32 of the movable member in a manner such that the applicator is preferably perfectly protected or well protected.

However, in this storage position, the recess 57 is preferably not sealed off from the air. The passage of air in this example is possible via the periphery of the movable member 30 or via the lower edge of the shell 54. The applicator element 20 is thus able to communicate with the ambient air when the recess is closed so that it is able to dry out between uses, which limits the risks of microbiological growth and can make it possible for example to reduce the quantity of preservatives in the product or biocidal agents incorporated into the applicator element.

In the storage position, the conduit 35 is no longer positioned against the hole 45, but it is the conduit portion 37 that is placed against the hole 45 thereby closing it off. The product delivery passage 60 is thus closed off so that the product emanating from the container is no longer able to reach the dispensing aperture 36, even if the user presses on the walls of the tube to expel the product.

Here again, it is ensured that the conduit 35 is no longer positioned against the hole because in this position the handle abuts against the edge 55 of the shell in the second notch 56, with the first notch 56 being closed by the sidewall 33 of the movable member.

A second embodiment of a packaging and applicator device is illustrated, also by way of example, in FIGS. 7 to 11.

The device 100 also includes a container 110 and an applicator element 120 carried by a movable member 130.

In this example, the container 110 is in the shape of a pot having a first end closed by a base 111 and an opposite end that terminates at a neck 112 along axis X. It is to be understood that other types of containers can be used in accordance with the invention, for example a bottle or a tube.

To expel the product, a dispensing element 170 in the form of a pump is mounted in the neck 112 via a mounting support 140. The pump 170 includes an actuating rod 171 which projects beyond the neck and extends on the axis X. The actuating rod 171 is hollow and allows the product to emerge from the pump.

The mounting support 140 includes fixing lugs 141 which snap onto a bead 113 provided on the neck of the container. A sealing skirt 142 bears in a leaktight manner on the inner surface of the neck 112 to provide a seal between the inside of the container and the support 140. The sealing skirt 142 and the fixing lugs are connected at their upper part by a transverse annular wall 143 which includes a central portion 144 extending radially towards the inside of the sealing skirt and which is raised relative to the rest of the transverse wall. The pump is fixed inside the central portion 144 which includes a central opening 145 traversed by the actuating rod 171 of the pump.

A groove 146 delineated by two axial walls surrounds the annular wall 143, the groove being itself surrounded by an outer covering skirt 147. Three openings 149 spaced at angles are formed in the bottom of the groove 146 and extend over part of the height of the axial wall delineating the groove which is outermost.

A stop 148 of which the function will be explained later is provided on the transverse wall 143, along the central portion 144. The stop 148 is T-shaped and extends parallel to the axis X, with the crossbar of the T tangent to the central portion in the illustrated example.

A guide wall 146*a* also extends parallel to the axis X, in the groove 146.

The movable member 130 includes two mutually parallel walls 131 and 132 spaced apart from one another. The two walls 131 and 132 are connected to one another by side walls 133 on only a part of their periphery. A handle 134 is provided between the two walls to manipulate the movable member. One of the two walls 131 additionally includes a conduit 135 which passes through its central part and which extends perpendicular to the wall 131, on either side of the latter. The conduit 135 emerges, at the outside of the wall 131, via a dispensing aperture 136 and extends between the two walls 131 and 132 by a conduit portion 137 parallel to the walls 131 and 132, which is configured to fit over the actuating rod 171 of the pump. The actuating rod emerges in the lower part of the conduit portion 137. In this instance the actuating rod 171 serves as the axis of rotation for the movable member which is able to turn around it. The conduit 137 extends at its upper part by a spike 138 of which the function will be explained later.

A projection 139 in the shape of an arc of a circle is provided on the face 131 of the movable member carrying the applicator element 120. The projection is formed on the periphery of the face 131, at its lower part.

The movable member 130 carries the applicator element 120 which in this example is detachably mounted on the movable member 130. The applicator element 120 is a closed-cell foam, for example. The applicator element 120 in this example is in the form of a disc with two flat faces 121 and 122, with one of the faces constituting the application surface 122. In this example, the foam is hollowed out at its central part through its full thickness so as to fit over the conduit 135 which projects beyond the wall 131. The opening 123 formed in the foam has a shape such that the foam fits tightly around the conduit 135 so that it is held in this position on the movable member. The end of the conduit 135 projects beyond the application surface 122, so that the dispensing aperture 136 emerges outside the applicator element. Furthermore, the end of the conduit 135 terminates at a bead 135*a* which facilitates fastening of the applicator element 120 in a correct position, that is to say in a position such that the aperture effectively emerges outside the application surface.

A cap 150 is mounted on the container so as to be capable of being displaced axially relative to the container.

In the illustrated example, the cap 150 includes a skirt 151, parallel to the axis X, which is designed to slide inside the groove 146 in the support 140. Three lugs 151*a* spaced at angles are formed at the bottom end of the skirt 151, with each lug having a projection 151*b* on its outer surface which is designed to locate under the upper edge delineating the counterpart opening 149 provided in the groove. Axial displacement of the cap is thus limited and in particular loosening of the cap 150 from the support 140 is avoided.

A slot 151*c* is also provided at the end of the skirt 151. The slot 151*c* is positioned against the guide wall 146*a* so as to allow the skirt 151 to move downward in the groove 146 and preferably avoiding any movement of the cap 150 other than on the axis X.

A transverse wall 152 which includes a passage 153 for the pump actuating rod 171 extends in the upper part of the skirt 151 along a diameter.

A hemispherical shell 154 is provided above the transverse wall 152. The shell is open at the front so as to receive the movable member 130 fitted with the applicator element 120. The edge 155 of the shell which delineates its opening 158 has a shape counterpart to that of the movable member so that the movable member is able to close off this opening. Two notches 156 are also provided on the edge 155, one on each side of the opening 158, to receive the handle 134 of the movable member.

A recess 157 is preferably thus delineated by the shell 154, the transverse wall 152 and the movable member 130. The recess is capable of accommodating the applicator element in the storage position.

In the illustrated example, the shell includes an aperture 159 in its upper part, into which the upper end of the spike 138 is inserted. This prevents or minimizes wobbling movement of the shell relative to the movable member when the pump is actuated.

Figure 7:
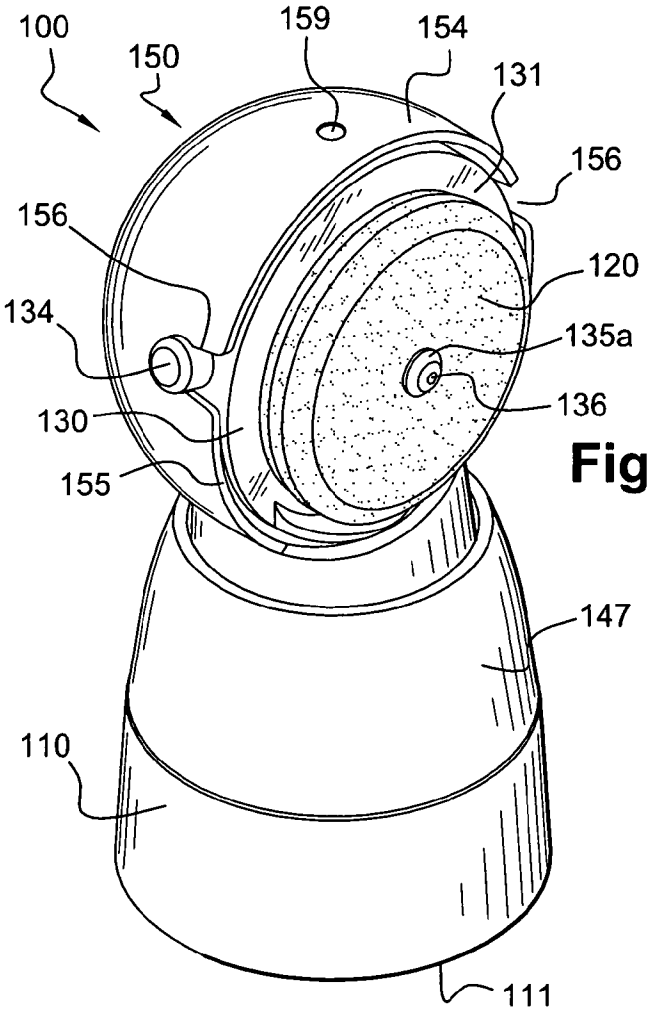
Figure 9:
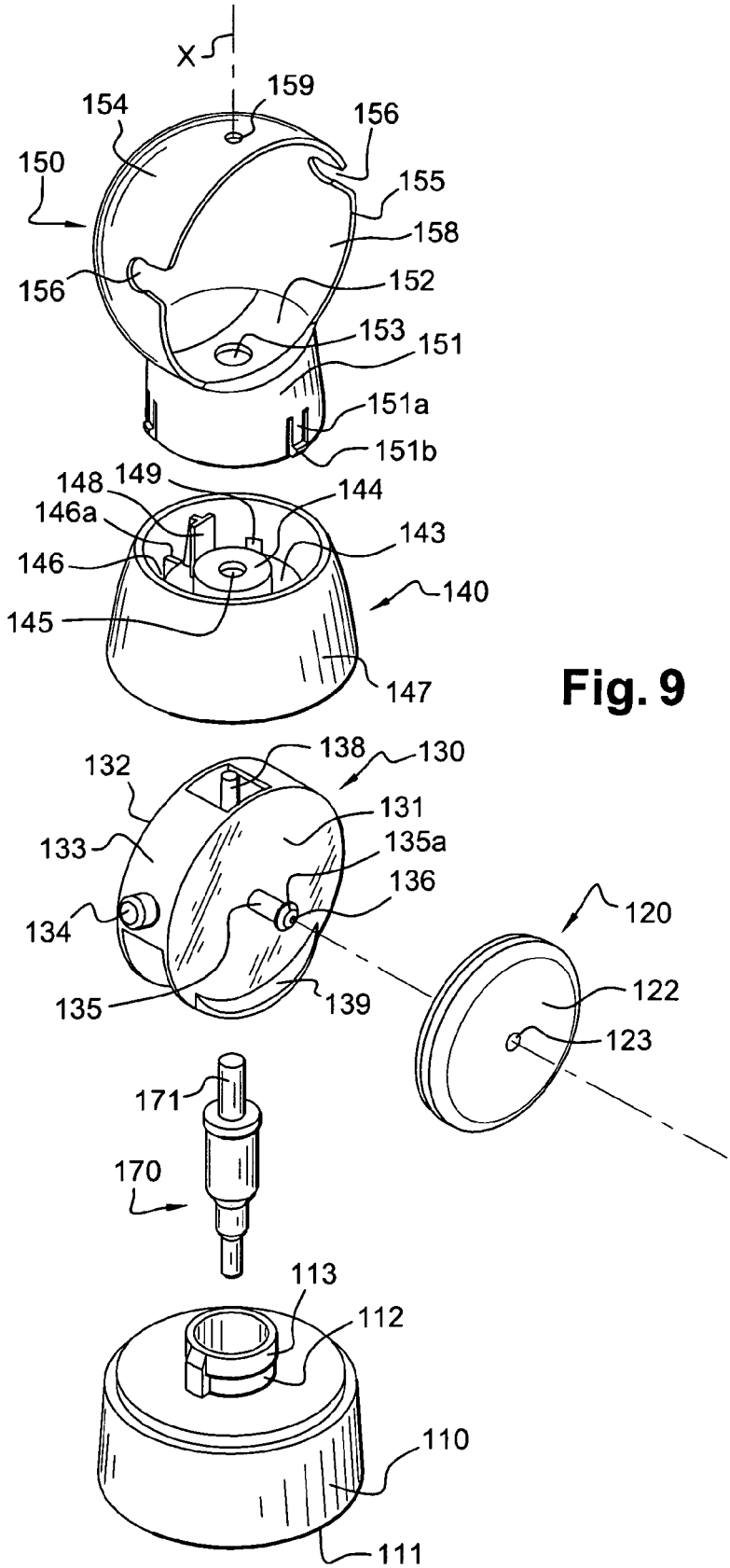
FIG. 9 illustrates an exploded view of the device in FIG. 7.
Figure 10:
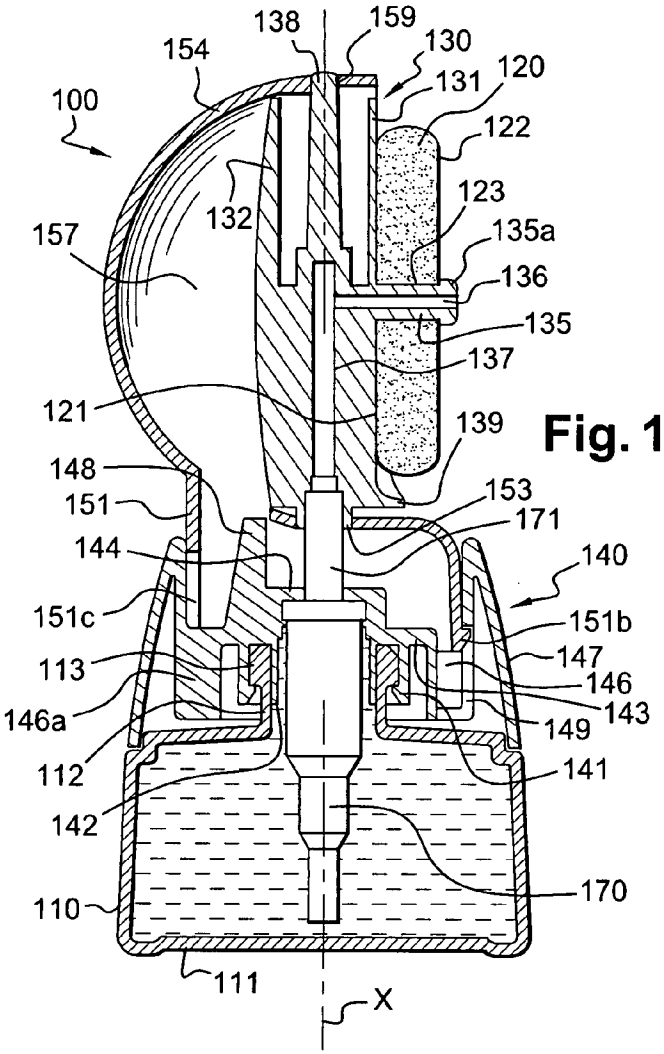
FIG. 10 illustrates, in axial cross section, the device in FIG. 7 in the use position.

In a use or application position depicted in FIGS. 7 and 10, the movable member 130 is in a first position, that is to say the wall 131 carrying the applicator element extends into the opening 158 in the shell. The applicator element 120 is then situated outside the shell and can be used to apply product on the surface to be treated.

In this application position, the smooth wall 132 of the movable member is located inside the recess, on the side of the stop 148, but at a distance from the latter.

By pressing on the shell 154 along the axis X, the cap 150 moves downward as does the actuating rod, and the skirt 151 moves downward into the groove 146. The product is thus expelled from the container via the actuating rod, through a passage 160 formed by the conduit portion 137 and the conduit 135, to the dispensing aperture 136. The product thus arrives at the application surface 122. The user can thus place this application surface 122 in contact with the surface to be treated in order to apply the product, for example while holding the device by the container. Alternatively, the user can remove the detachable applicator element 120 and use it as a simple sponge.

To ensure that the cap can move downwards, the handle 134 advantageously abuts against the edge 155 of the shell in this position, with the handle being located in the notch 156.

When the application is complete, the user can stow the applicator element 120 to prevent it from being soiled between uses, after replacing it on the movable member if it has been detached.

Figure 8:
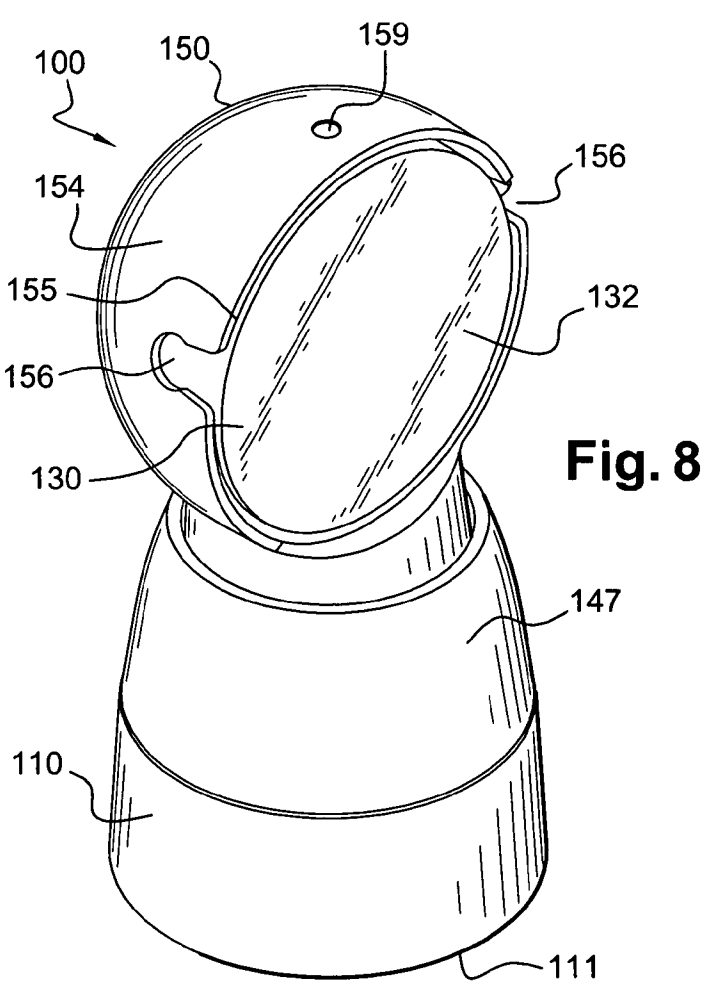
FIGS. 7 and 8 illustrate perspective views of a second example of a packaging and applicator device according to the invention, in different positions.
Figure 11:
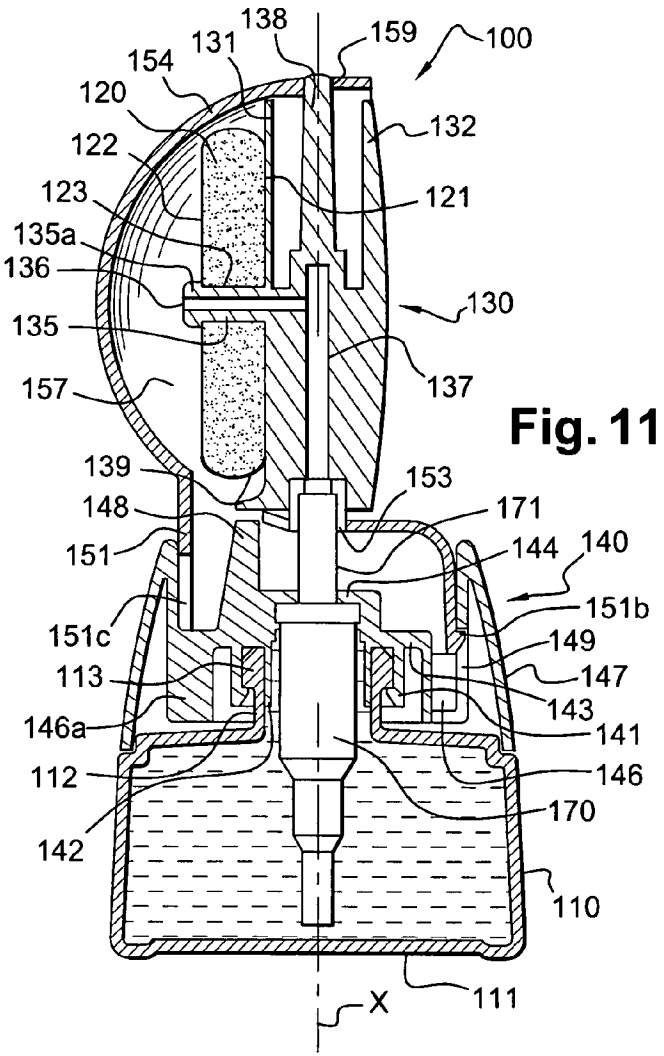
FIG. 11 illustrates, in axial cross section, the device in FIG. 7 in the closed position.

To do this, the user turns the movable member 130 by grasping the handle 134 until it has rotated through 180°. The device is thus in its storage position, as depicted in FIGS. 8 and 11, a position in which the applicator element 120 is wholly enclosed within the recess 157. The recess 157 is closed by the wall 132 of the movable member such that the applicator is preferably perfectly protected or well protected, while at the same time enabling air to enter via the periphery of the movable member 130.

In the storage position, the wall 131 of the movable member which includes the projection 139 is located inside the recess, on the side of the stop 148 and against the latter, so that when pressure is applied to the shell 154 the cap 150 cannot move downward because the projection 139 bears against the stop 148. The pump thus cannot be actuated and the product cannot leave the container.

In the detailed description above, reference is made to preferred embodiments of the invention. It is evident that variants thereto can be proposed without departing from the invention as claimed here below. Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for packaging and applying a product, comprising:

a container holding the product;

an applicator element designed to be supplied with product via a passage in permanent or selective communication with the inside of the container, wherein the applicator element includes an application surface which can be placed in contact with a surface to be treated;

wherein the applicator element is carried by a movable member which is movable from a first position in which the applicator element is exposed to an outside of a recess surmounting the container, to a second position in which the applicator element is contained within the recess, and wherein the movable member includes a portion closing off the recess in the second position, and further wherein the movable member performs at least one of the following functions when it is in the second position:

preventing the actuation of a dispensing element fitted on the container, and/or closing off the product delivery passage to the applicator element.

2. A device according to claim 1, wherein the movable member is rotatably movable between the first position and the second position.

3. A device according to claim 2, wherein the movable member is displaced through approximately 180° between the first and the second position.

4. A device according to claim 1, wherein the movable member is rotatably movable about a tubular wall at least partly delineating the product delivery passage.

5. A device according to claim 4, wherein the movable member includes a conduit portion fitted over the tubular wall.

6. A device according to claim 5, wherein the conduit portion closes off a hole provided in the tubular wall so as to close off the passage when the movable member is in the second position.

7. A device according to claim 6, wherein the conduit portion is extended by a conduit which emerges via a dispensing aperture, with the conduit being positioned against the hole of the tubular wall when the movable member is in the first position.

8. A device according to claim 1, wherein the movable member is rotatably movable about an actuating element of the dispensing element.

9. A device according to claim 8, wherein the movable member is movable downwardly along an axis of the actuating element to actuate the dispensing element when the movable member is in the first position.

10. A device according to claim 9, wherein the movable member includes a wall which abuts against a support of the dispensing element when the movable member is in the second position.

11. A device according to claim 1, wherein the movable member includes a handle to be grasped to assist in turning the movable member to move the movable member between the first and second positions.

12. A device according to claim 11, wherein the handle abuts against a stop in the first position and in the second position.

13. A device according to claim 1, wherein the applicator element communicates with ambient air when it is contained within the recess in the second position.

14. A device according to claim 1, wherein the applicator element is compressible.

15. A device according to claim 14, wherein the applicator element includes a foam or an elastomer.

16. A device according to claim 1, wherein the applicator element includes a domed application surface.

17. A device according to claim 1, wherein the passage for the product extends outside the application surface via a dispensing aperture.

18. A device according to any one of claim 1, wherein the passage for the product extends to a location inside the applicator element via a dispensing aperture.

19. A device according to claim 1, wherein the applicator element is made of a porous material.

20. A device according to claim 1, wherein the applicator element is bonded to the movable member at a face opposite to the application surface.

21. A device according to claim 1, wherein the applicator element is detachably mounted on the movable member so that the applicator element can be picked up before being applied to the surface to be treated.

22. A device according to claim 21, wherein the applicator element is attached to the movable member by fitting around a conduit emerging via the dispensing aperture.

23. A device according to claim 1, wherein the container includes a flexible wall on which the user can press to dispense the product.

24. A device according to claim 1, wherein the dispensing element is a pump which includes an actuating element to dispense a quantity of product in response to an actuating command, when the movable member is in the first position.

25. A device according to claim 1, wherein the product is fluid.

26. A device according to claim 1, wherein the product in said container is a cosmetic product.

27. A device according to claim 1, wherein the passage for the product opens at a location behind said applicator element on a side of said applicator element opposite to said application surface.

28. A device according to claim 1, wherein the passage for the product extends through said applicator element.

29. A device according to claim 1, wherein the device includes a cap within which said recess is disposed, said cap including an opening within which said applicator element is disposed, and wherein in said first position said application surface faces outwardly from said opening such that said application surface is exposed, and wherein in said second position said application surface faces inwardly of said opening and is positioned in said recess.

30. A device according to claim 29, wherein said cap is movable to actuate an actuator to dispense said product, an wherein said applicator element moves with said cap during an actuating movement when said applicator element is in said first position, and wherein said applicator element moves relative to said cap during movement from said first position to said second position.

31. A device according to claim 30, wherein an actuating movement of said cap is inhibited when said applicator element is in said second position.

32. A device according to claim 31, wherein said applicator element rotates relative to said cap from said first position to said second position.

33. A device according to claim 29, wherein in said second position an outlet end of said product delivery passage is not in communication with an interior of said container.

34. A device according to claim 33, wherein said container includes a flexible wall such that the product is dispensed by exerting a force against said wall when said applicator element is in said first position.

35. A device according to claim 29, wherein a tubular wall extends into said cap and defines a portion of the product delivery passage, and further wherein said mounting member is rotatably mounted on said tubular wall for movement between said first and second positions.

* * * * *

UNITED STATES PATENT AND TRADEMARK OFFICE

CERTIFICATE OF CORRECTION

PATENT NO. : 7,690,854 B2
APPLICATION NO. : 11/418369
DATED : April 6, 2010
INVENTOR(S) : Jean-Francois Delage It is certified that error appears in the above-identified patent and that said Letters Patent is hereby corrected as shown below:

Column 10, line 20, change “an” to -- and --.

Signed and Sealed this

Seventh Day of September, 2010

David J. Kappos

David J. Kappos
*Director of the United States Patent and Trademark Office*